US010662600B2

(12) United States Patent
Philipsen

(10) Patent No.: US 10,662,600 B2
(45) Date of Patent: May 26, 2020

(54) PORTABLE FLOOD BARRIER SYSTEM AND METHOD OF MONITORING SAID SYSTEM

(71) Applicant: Environment Solutions ApS, Roskilde (DK)

(72) Inventor: Anders Philipsen, Kerbokan (ID)

(73) Assignee: ENVIRONMENT SOLUTIONS APS, Roskilde (DK)

( * ) Notice: Subject to any disclaimer, the term of this patent is extended or adjusted under 35 U.S.C. 154(b) by 0 days.

(21) Appl. No.: 16/315,012

(22) PCT Filed: Jun. 29, 2017

(86) PCT No.: PCT/DK2017/050215

§ 371 (c)(1),
(2) Date: Jan. 3, 2019

(87) PCT Pub. No.: WO2018/006915

PCT Pub. Date: Jan. 11, 2018

(65) Prior Publication Data

US 2019/0257048 A1 Aug. 22, 2019

(30) Foreign Application Priority Data

Jul. 4, 2016 (DK) ..... 2016 70489

(51) Int. Cl.
*E02B 3/10* (2006.01)

(52) U.S. Cl.
CPC ..... *E02B 3/108* (2013.01)

(58) Field of Classification Search
CPC . E02B 3/108; E02B 3/127; E02B 3/04; Y02A 10/13; Y02A 10/32
See application file for complete search history.

(56) References Cited

U.S. PATENT DOCUMENTS 4,498,810 A 2/1985 Muramatsu et al.
4,555,201 A * 11/1985 Paoluccio ..... E02B 3/108 405/117
4,981,392 A 1/1991 Taylor
5,971,661 A * 10/1999 Johnson ..... E02B 3/108 405/114
6,957,928 B1 * 10/2005 Lofton ..... E02B 3/108 405/111

(Continued)

FOREIGN PATENT DOCUMENTS

CH 704 379 A1 7/2012
CN 205205777 U 5/2016

(Continued)

OTHER PUBLICATIONS

International Search Report and Written Opinion, Appl. No. PCT/DK2017/050215, dated Oct. 6, 2017.

*Primary Examiner* — Carib A Oquendo
(74) *Attorney, Agent, or Firm* — Winston & Strawn LLP

(57) ABSTRACT

A flood protection system that includes at least one elongated flexible tube arranged for being filled with a liquid and containing such liquid, at least one rigid coupling unit arranged for interconnecting the flexible tubes, and a monitoring system that includes at least one liquid level indicator arranged for measuring the liquid level inside the at least one coupling unit. The system ensures that that any leak in one or more of the flexible tubes or any malfunction of the coupling unit can easily be detected.

12 Claims, 2 Drawing Sheets

(56) References Cited

U.S. PATENT DOCUMENTS

| | | | | |
|---|---|---|---|---|
| 7,494,016 | B2 * | 2/2009 | Garifulin | B03D 1/02 209/164 |
| 7,762,742 | B1 * | 7/2010 | Smith | E02B 3/108 405/114 |
| 2005/0260038 | A1 * | 11/2005 | Sousa Costa | E02B 3/108 405/115 |
| 2007/0207306 | A1 | 9/2007 | Broughton et al. | |

FOREIGN PATENT DOCUMENTS

| | | | |
|---|---|---|---|
| DE | 10 2005 006 507 | A1 | 8/2006 |
| DK | 2012 00570 | A1 | 3/2013 |
| WO | 98/04781 | A1 | 2/1998 |
| WO | 99/41459 | A1 | 8/1999 |
| WO | 01/61113 | A1 | 8/2001 |

* cited by examiner

PORTABLE FLOOD BARRIER SYSTEM AND METHOD OF MONITORING SAID SYSTEM

This application is a 371 filing of International Patent Application PCT/DK2017/050215 filed Jun. 29, 2017, which claims the benefit of Danish application PA 2016 70489 filed Jul. 4, 2016.

BACKGROUND

The invention relates to a portable flood barrier system and a method of monitoring said system.

Flooding, caused by heavy rain, storms or melted snow, is a problem causing great economical damage and sometimes personal injury. For the purpose of flood control various types of barricades are built.

Permanent flood protection devices such as levies are well known. However, it is often necessary to create a temporary, emergency barrier to flooding. Historically, the emergency barrier of choice has been the sandbag. However, sandbags have a number of drawbacks. They are extremely labour intensive and time-consuming to fill and transport to the site where they are to be used. Moreover, suitable fill material may not always be available in sufficient quantity. Still further, when the bags are no longer needed, a way must be found to dispose of and/or remove the fill material, another time-consuming and labour intensive activity and one that will require the presence of a suitable dumping area for the fill material.

Therefore water-fillable flood-tube barriers are increasingly used as a quick and efficient flood protection solution. The mainly cylindrical tubes are made of a flexible material and can e.g. be connected to traditional fire hoses and, when filled with water, used at sites threatened by flood.

Such a system is e.g. known from U.S. Pat. No. 4,981,392 which describes a water inflatable structural system for constructing temporary dikes and related structures. Said system comprising two identical elongated flattened tubes joined together by a flexible web alongside each other. The tubes can be inflated with water.

SUMMARY OF THE INVENTION

Other similar systems are also known in the art, but a general problem with these portable flood barriers according to prior art is that in order to be able to withstand the impact of the flood, the barriers must be "full" with e.g. water in order to give the barriers sufficient mass to resist deflection and deformation. However, if the barriers have not been filled with sufficient water or water leaks from the barrier, the performance of the barrier is prejudiced. Similar, it is important to ensure that the tubes are not filled excessively, as this might cause tears, punctures and/or other damages to the tubes leading to a progressive failure of the flood protection system It is accordingly important that the flood protection system continuously are monitored to ensure that the barriers do not leak and that they contain the correct amount of water, i.e. an amount sufficient for providing an effective barrier, but not so much that the stability and integrity of the system is influenced. However, as flood barrier often are to be used in extreme weather conditions and since they can be very long and cover large areas, there is presently no easy way of checking that the barriers have not been damaged and that they contain the optimal and desired amount of water.

Accordingly, it is a first aspect of the present invention, to provide a flood protection system arranged for being easily monitored, even in extreme weather conditions.

It is a second aspect of the present invention to provide a flood protections system in which a leak, rupture or the like in said system easily can be detected and located.

It is a third aspect of the present invention to provide a flood protection system which can be monitored and operated from a remote location.

It is a fourth aspect of the present invention to provide a method in which a flood protection system can be easily, quickly and securely monitored, in all weather conditions.

The novel and unique features whereby these and further aspects are achieved according to the invention is the fact that the flood protection system comprises

- at least one elongated flexible tube arranged for being filled with a liquid and containing said liquid,
- at least one rigid coupling unit arranged for interconnecting the flexible tubes, and
- a monitoring system comprising at least one liquid level indicator arranged for measuring the liquid level inside the at least one coupling unit.

The system according to the invention comprises at least one elongated flexible tube arranged for being filled with a liquid and containing said liquid in the flexible tube, thereby providing a barrier in an area e.g. threatened by flooding.

Since the tubes are flexible they will collapse and expand depending on the amount of liquid present in the tubes, making it impossible to predictable determine the liquid level inside said flexible tubes. Furthermore, it will be very difficult to visually observe the liquid level inside the tubes, not only because the liquid level will be influence by the terrain, but also because visual inspection might be difficult due to the extreme weather condition and the often large areas which needs to be protected by flooding. Furthermore sometimes the tubes may be filled with a combination of air and liquid, making it impossible, or at least very difficult, to see to which extend or level the tubes are filled with liquid.

Accordingly, the inventor of the present invention has surprisingly found that by measuring the liquid level inside the rigid coupling units, i.e. the parts of the flood protection system that cannot be influenced by differences in the terrain and/or the degree of expansion/contraction of the flexible tube, it is possible to accurately measure the liquid level inside the flood protection system and thereby obtain a predictable indication as to the overall condition of the flood protection system both before, during and after use.

Conventionally, level indicators are placed outside areas threatened by flooding for detecting changes in the height of the water which is threatening to create the flooding e.g. during storms. This will ensure, that it is possible to raise flood protection barriers before the flooding occurs. However, this is very different from the flood protection system according to the present invention, were the liquid level is measured inside the coupling units used to interconnect a number of flexible tubes, thereby providing a way of monitoring the flood protection system itself and observe if said system is effective in preventing flooding in the protected areas, and if not, take the necessary precautions in order to ensure that the flood protection systems ability to protect the relevant areas is re-established.

Said coupling unit are rigid constructions, i.e. they will have the same dimensions independently of the liquid level in the flood protection system and the forces acting upon the coupling units and the flexible tubes making them highly usable as a measurement point for the liquid level indicator. The coupling units are in agreement herewith made of a materials meeting these requirements, e.g. steel, aluminium or a rigid polymer material, as this will not only provide a rigid coupling unit, but also a unit which is made of an inexpensive material.

One preferred coupling unit is e.g. known from DK201200570 and reference is made to said application for further details in respect of said coupling unit. Other kinds of coupling units are also contemplated within the scope of the present application. A persons skilled in the art will based on the teaching in the present application understand that the coupling unit in principal can have any design and any dimension, as long as they are rigid constructions, and are arranged for either connecting at least two flexible tubes or for closing an end of a flexible tube.

In a preferred embodiment the system according to the invention comprises at least two, and preferably a number of flexible tubes which can be quickly joined end-to-end by means of the coupling units. Said coupling unit is preferably placed at one or both ends of the flexible tube, such that more than one flexible tube can be interconnecting (linked together) thereby forming a flood protection system of virtually any length.

Since a single leak or rupture in one flexible tube will likely not disrupt the function the whole system, it is relevant that the monitoring system is arranged for individually measuring the liquid level inside a number of coupling units. It is in this respect preferred that a number of liquid level indicators are distributed at regular intervals along the length of the flood protection system, e.g. by placing a liquid level indicator in all, in every second, every third or every forth coupling unit along the flood protection system.

It is however preferred that the monitoring system is arranged for individually measuring the liquid level inside each coupling unit of the flood protection system, thereby ensuring that the liquid level can be measured accurately along the entire length of the flood protection system. This can e.g. be achieved if each coupling unit comprises an individual and independent liquid level indicator.

It should be noted, that a multiplicity of flexible tubes connected end-to-end may be arranged in e.g. a straight line and/or a curved line in order to provide a barrier in the area of interest. It is further preferred that the flexible tubes can be stacked atop one another or next to each other forming barriers of variable heights, width and shapes, thereby providing a flood protecting system which is flexible, durable and effective.

However, irrespectively of the flood protecting systems dimensions, it is preferred that the monitoring system is arranged for monitoring the entire flood protection system, as this will ensure that any leak in one or more flexible tubes and/or any malfunction of a coupling unit easily can be detected.

In a preferred embodiment the monitoring system is arranged for transmitting an alert if the liquid level in at least one first coupling unit is different from a predetermined set value of said first coupling unit. Said set value is preferably based on the desired amount of liquid present in the flood protection system, and may vary individually along the flood protection system. However, in most situations it is preferred that the predetermined set value is an interval indicating that about 95% to 98% of the tubes inner volume is filled with liquid. The tubes are preferably not filled completely or excessively, as this will make them more susceptible to damages, e.g. by sharp objects in the terrain, and liquid volumes below said predetermined set value will impact the respective tubes ability to withstand the impact of the flood.

Said alert can in one embodiment be a simple visual and/or audible alarm transmitted directly by the respective liquid level indicator. However, it might be difficult for an operator to be close enough to the flooding system to be able to visual and/or audible detect such alarms e.g. due to the weather conditions or the extent of the protection system. It is therefore preferred that the monitoring system comprises one or more operating units arranged for receiving and processing data/signals relating to the liquid level measured by a respective liquid level indicators in the flood protection system. This will not only enable an operator to constantly monitor the condition of the whole flood protection system, but also that the operator can be alerted centrally, i.e. via said operating unit, that the liquid level in one or more coupling unit is different from the predetermined set value.

Said operating units can be any kind of device capable of receiving and processing the relevant data, but can in a preferred embodiment be a small electronic device e.g. a tablet or mobile phone; an Programmable Logic Controller (PLC) or a personal computer. However, in another preferred embodiment the operating unit is a centralised command centre dealing with other problems related to the flooding, e.g. power failure. In any case, the monitoring system comprises relevant software for handling the data received and for controlling the operation of the monitoring system. This gives the operator of the flood protection system the possibility of automatically monitoring the entire flood protection system both before, during and after use.

Since the flood protection system can be very long, be placed in difficult terrain, and used in extreme and hazardous weather conditions, it is furthermore preferred that the monitoring system is arranged for linking data from a specific liquid level indicator together with the position of said indicator. In this way it is ensured that the operator easily can established where, in a normally very long flood protection system, a problem has occurred and accordingly correct said problem without first having to search along the entire flood protection system.

The relevant liquid level indicators position can in one embodiment be obtained by a simple numbering system, where each coupling unit has a number, preferably continuously along the length of the flood protection system, and the data send from the respective liquid level indicators are linked to said number. However, in another embodiment each coupling unit or liquid level indicator, comprises a small GPS-transmitter, whereby it is possible to exactly position the respective coupling unit and/or indicator. The latter can be an advantages since this will allow the establishment of a visual image of the system, showing the respective coupling units schematically, and thereby allow the operator to "visually" inspect the system from a remote location. This also ensures, that when an alert is raised the relevant coupling unit and/or indicator in said coupling unit can visually flare up. Such visual inspection systems are known in the art, and the person skilled in the art would based on the teaching in the present application be able to implement the known art in the monitoring system of the present invention.

In a preferred embodiment the at least one coupling unit is arranged for introducing and removing liquid, such as water, into the flexible tubes using a pumping system. The liquid to be used need not be potable, and is preferably pumped from the body of liquid, e.g. water that is threatening to create the flood condition. The coupling units preferably establishes a liquid flow communication between the interconnected tubes, as this will ensure that the tubes can be filed with liquid from a single central origin.

The pumping system may be an external pumping system or be part of the flood protection system, but irrespectively the monitoring system may comprises means for adjusting the liquid flow to and from the system in dependence of the data from one or more of the liquid level indicator(s). For instance, the monitoring system will ensure that if the liquid level in one coupling unit is lower than the predetermined set value, the pumping system will add liquid to the flood protection system until the set value has been re-established. Similar the monitoring system can remove liquid if the liquid level in one coupling unit is higher than the predetermined set value. This adjustment of liquid flow of into or out of flood protection system is preferably achieved automatically, i.e. the monitoring system comprises a feedback mechanism that automatically will adjust the liquid flow, if one or more liquid level indicator measures a liquid level which is different from the predetermined set value(s).

Said flow adjustment can e.g. be an opening and/or closing of the liquid flow to said flood protection system but it can also be an adjustment in the liquid flow rate to said system.

In a similar manner the monitoring system can be operatively linked to one or more external liquid level indicators, i.e. indicators that are placed outside the area that is threatened by flooding. If said external liquid level indicators detects changes in the water height e.g. during storms, said monitoring system can either automatically activate the pumping system filling the flexible tubes and raise the flood protection system according to the invention before the flooding occurs, or be manually activated e.g. via the operating unit. Accordingly, a complete monitoring system is provided which can be operated, controlled and monitored via e.g. a centralised command centre.

In a preferred embodiment the pumping system is connected to a number of coupling units along the entire length of the flood protection system. This will not only ensure that the flood protection system can be filled with liquid very quickly, but also that only the liquid flow to certain sections of the flood protection system needs to be adjusted in dependence of data from the liquid level indicator(s), i.e. only the liquid flow to the flexible tubes which is adjacent/nearby to the coupling unit in which a liquid level indicator measures a liquid level that different from the set value, needs to be adjusted.

Since the liquid level indicators in the coupling units during filling and emptying unavoidably will measure liquid levels off-set from the predetermined set values, it is preferred that the monitoring system is inactivated in such periods, as this will prevent irrelevant alerts being raised. Thus it is preferred that the monitoring system can be activated and/or shut down manually from the operating unit. Alternatively, the monitoring system can comprise means for detecting when the majority e.g. 90% of the liquid level indicators in the flood protection system measures liquid levels that are either different from—or at—the predetermined set value, and activate or inactive the monitoring system in dependence thereof.

The liquid level indicators used in the present invention can be any kind of liquid level indicator capable of monitoring the relevant liquid level in a coupling unit. Liquid level indicators are well known, and a person skilled in the art would based on the teaching in the present invention be able to select a suitable indicator.

It is however preferred that the liquid level indicator used in the preset invention operates by means of the float principle for measuring the relevant liquid level, and preferred indicators are conventional magnetic, mechanical or magnetostrictive float level sensors. Alternatively the liquid level indicators can be replaced by other kinds of liquid level units, e.g. sensors, lasers, infrared and/or ultrasonic systems for measuring.

It is further preferred that the liquid level indicator is arranged for being quickly and easily attached to one or more coupling units at any convenient position without materially altering the structure of the coupling unit.

The flexible tubes can be fabricated from any desired flexible material which is waterproof, i.e. liquid tight, it is however preferred that the flexible tubes both have a high flexibility (requires less storage space) and a high strength. Thus, in a preferred embodiment each flexible tube comprise more than one layer, wherein each layer is made of the same or different kinds of material. For instance, if the flexible tube comprises two concentrically arranged layers, providing an inner and outer tube, the inner tube could be made of a material being impermeable for liquids (liquid tight), e.g. polypropylene, and the outer tube could be made of a higher strength flexible material such as fiber reinforced material or the like, enabling the overall flexible tube to have both liquid proof characteristics (inner tube/layer) and high mechanical strength (outer tube/layer). In a preferred embodiment the diameter of the inner tube is larger than the diameter of the outer tube, such that when liquid is filled in the inner tube, said inner tube will expand outwards until the diameter of the outer tube is met, providing a highly stable structure.

Irrespectively of the material chosen it is preferred that the material is chosen such that an operator is able to repair a damaged section, e.g. by welding on an outer membrane/patch to said section.

As an example of the flood protection system according to the invention can be mentioned, that if the flood protection system comprises thirty coupling units, spaced e.g. 100*m* apart, and when a single liquid level indicator both sends data that the liquid level is different from a predetermined set value, and information relating to the corresponding coupling units position in the flood protection system, it will be very simple for the operator to accurately locate the specific coupling unit even in extreme weather conditions. If said liquid level indicator signals that the liquid level is to low in the respective coupling unit, this could indicate that one of the tubes connected to said coupling unit has been damaged, e.g. due to a puncture or tear. In case of damage to only a single tube, the entire barrier will not fail and the amount of liquid in the damage tube can initially be regulated simply by adjusting the amount of liquid added either to the total system or to a coupling unit at or near the measurement site, preferably automatically using a feedback mechanism between the pumping system and the monitoring system. The damaged tube(s) can then be replaced or reinforced in situ later when this is considered appropriate, e.g. when the weather clears up or the weather conditions are less hazardous. However, extensive damage to the flood protection system can cause major leakage, which cannot be corrected by continuously adding liquid to the flood protection system. Instead it will be necessary to repair the damaged sections and/or tubes instantly, start deploying a second line of defense, e.g. by adding an extra tube and/or deploying a new barrier system, or make the decision of evacuating the area. In such situations the monitoring system used in the present invention, ensures that the problem, e.g. a leak/tear is located quickly, since the operator will not have to visually inspect a large area in order to find the error, but can specifically target the exact location based on the information obtained via the monitoring system, and correct the failure, e.g. by repairing the damaged section by applying an outer membrane/patch to said section, deploy a second line of defense, or evacuate.

It should be noted that damages or tears to the system may not only be related to natural causes, such as an excessive pressure inside the flexible tubes or punctures due to sharp objects in the terrain in which the flood protection system is place, but may also be cause by vandals. The latter is e.g. relevant if the flood protection system is intended for remaining at a specific location, which often is threatened by flooding.

It should be noted that the flood protection system according to the invention, may be modified in that it is a storage system i.e. the system according to the invention is used for storage of different kind of liquids, oil, water or spills. In such situations the material added to the flexible tubes are the material which are to be stored. The liquid level indicators works in the same manner as discussed above, and a difference in the liquid level from a predetermined set value, will indicate that the stored liquid is seeping out of the storage system.

The present invention also relates to a method for monitoring the state of a flood protection system, said method comprises

- provide a flood protection system according to the invention, and measuring the liquid level inside at least one coupling unit,
- establishing if said liquid level differs from a predetermined set value for said coupling unit, and
- adjusting the flow of liquid to and from the flood protection system in order to obtain and/or maintain the predetermined set value for said coupling unit.

In a preferred method according to the invention, the liquid level inside each coupling unit is measured, and it is established if said measured liquid level differs from a predetermined set value for each respective coupling unit.

Said method preferably also links data relating to a liquid level measured by a specific liquid level indicator to information relating to said indicators position in the flood protection system, and this will ensure that it is possible to locate a problem in the flood protection system easily.

Preferably all data and events are logged for later review e.g. on a memory device known in the art. The user can thus at a later time enter the memory containing the logged data and review/evaluate which consequences a damage had on the overall flood protection system and how the different steps in the entire method were carried out.

The invention will be explained in greater detail below, describing only exemplary embodiments of the inlet stratification device according to the invention, in which

The invention will be described below with the assumption that the system according to the invention is used in an area threatened by flood, and the flexible tube comprises a single layers. However this assumption must not to be construed as limiting, and the flexible tube can just as easily comprise two or several layers and the system be used for different purposes, e.g. storage of a liquid.

DETAILED DESCRIPTION OF THE INVENTION

Figure 1:
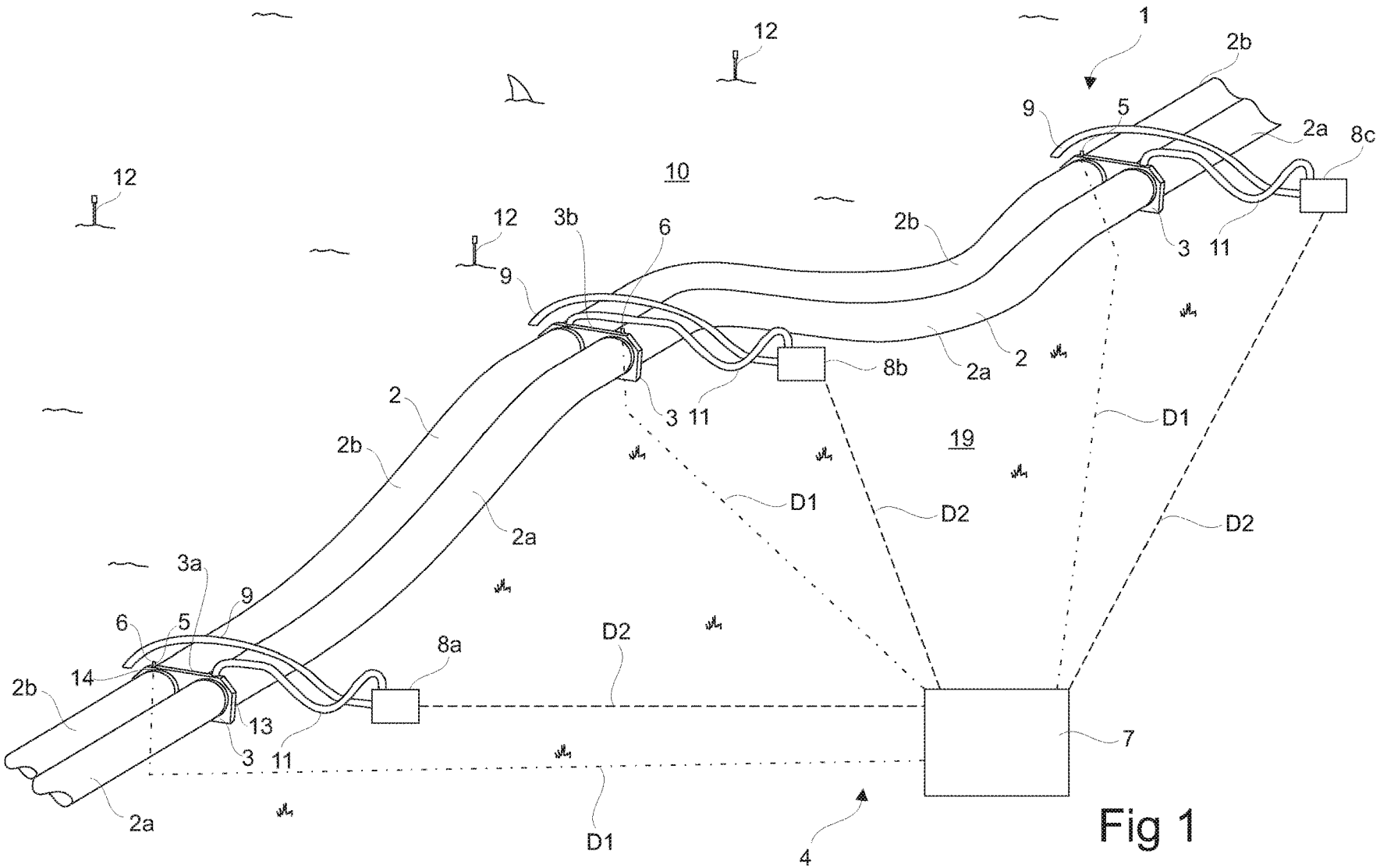
FIGS. 1 and 2 shows a preferred embodiment of a flood protection system according to the invention.
Figure 2:
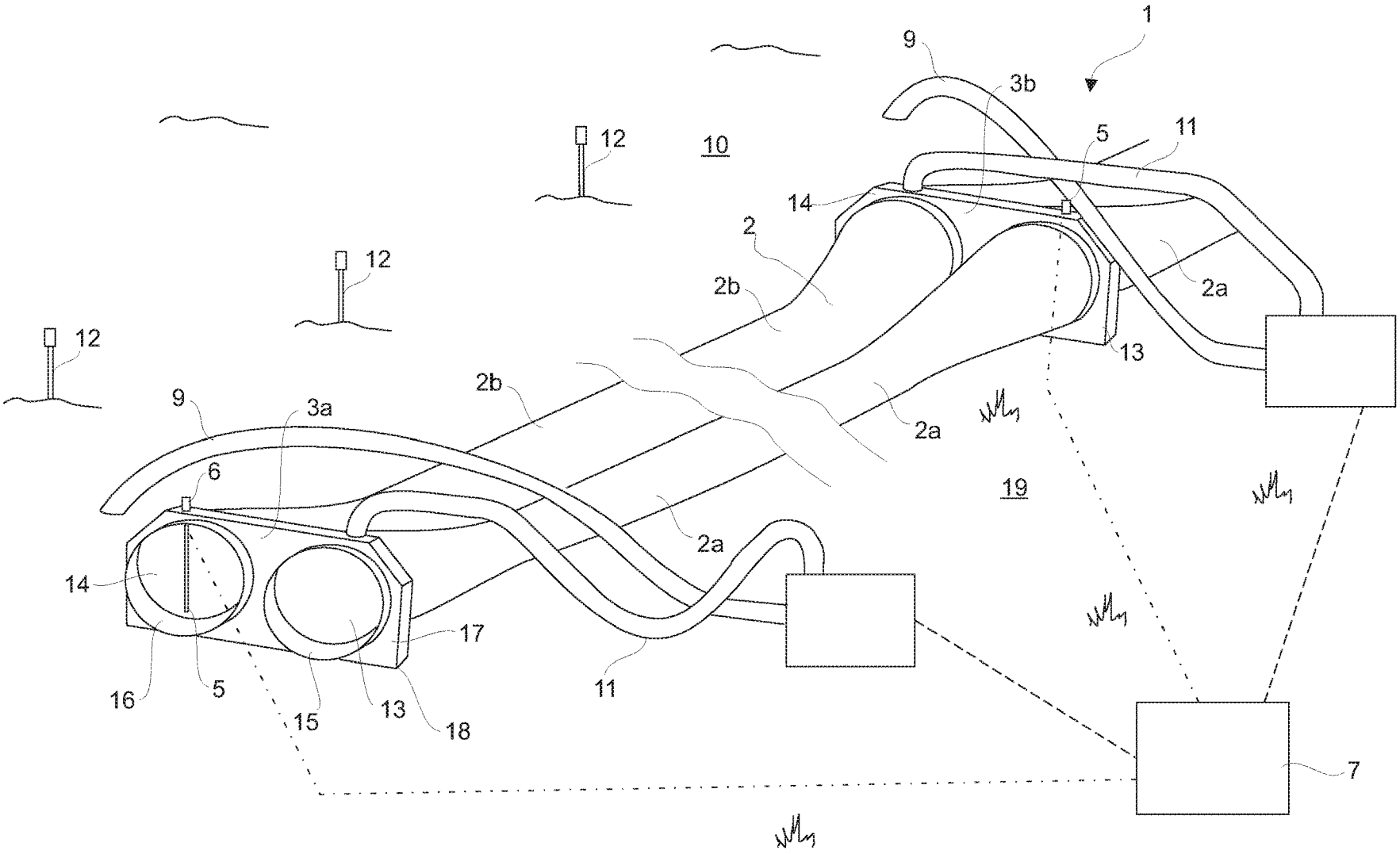

FIG. 1 shows a schematic view of preferred embodiment of a system 1 according to the invention. In FIG. 1 the system are filled with water, whereas FIG. 2 shows the system with a limited amount of water. FIG. 2 further shows the embodiment in larger details and provides a view inside the system.

The system of FIGS. 1 and 2 comprises a number of flexible tubes 2 divided into two separate sets of interconnected flexible tubes 2*a*,2*b*. A number of rigid coupling units 3 are arranged for joining the flexible tubes 2 end-end, i.e. tubes 2*a* are connected end-to-end, and tubes 2*b* are connected end-to-end, i.e. there is provided a liquid flow communication between the flexible tubes of each set. Each set 2*a*, 2*b* of flexible tubes 2 will in principal provide an individual flood protection system, and it is therefore preferred that there is no liquid flow communication between the two sets, i.e. no flow communication between the flexible tubes 2*a* and 2*b*.

The system further comprises a monitoring system 4 comprising a number of liquid level indicators 5 arranged for measuring the liquid level inside each their respective coupling units 3. This is best illustrated in FIG. 2, in which a view inside the coupling unit 3 and the flexible tubes 2 are provided, showing one preferred placement of the liquid level indicator 5 in the coupling unit 3.

The liquid level indicators 5 are not only arranged for measuring and processing the liquid level in the rigid coupling unit 3, but also for transmitting an alert if the water level in said coupling unit 3 is different from a predetermined set value. Said alert can e.g. be a visual and/or audible alarm placed on or in vicinity of the liquid level indicator, e.g. by means of lamp 6 and/or a speaker (not shown). In addition thereto, the alert can be transmitting to the one or more remote operating units 7 arranged for receiving and processing data relating to the liquid level measured by the respective liquid level indicators. Said operating unit 7 is in FIG. 1. illustrated as a simple box, which is arranged for communicating wireless with the liquid level indicators 5, illustrated by the dotted line D1 in FIG. 1, and thereby be able to monitor and/or control the entire flood protection system 1. The operating unit 7 can be any kind of device capable of receiving and processing the relevant data, e.g. a small electronic device such as a tablet or mobile phone; a Programmable Logic Controller (PLC), a personal computer and/or a centralised command centre.

The monitoring system 4 further comprises a pumping system 8 which also communicates with the control unit 7, illustrated by the dotted line D2 in FIG. 1. The pumping system 8 is arranged for introducing liquid, such as water, into the flexible tubes. The pumping system comprises a number of individual pumps 8*a*,8*b*,8*c* each being connected to a coupling unit 3, and wherein each pump 8 via a first tube 9 pumps water, from the body of water 10 that is threatening to create the flood condition, into the flexible tubes 2 via a second tube 11. This will ensure that the flood protection system 1 can be filled with liquid (or emptied by a reverse action) very quickly.

In order to adjust the liquid flow to and from the flexible tubes in dependence of the data from the respective liquid level indicator(s) 5, the monitoring system 4 comprises means, e.g. conventional computing and adjustment means present in the operating unit 7 arranged to ensure that if the liquid level in one coupling unit 3 is lower than the predetermined set value, the pumping system 8 will add liquid to the flood protection system 1 until the set value has been re-established. Alternatively, or in addition thereto, the monitoring system 4 can remove liquid if the liquid level in one coupling unit 3 is higher than the predetermined set value.

This adjustment of liquid flow in or out of the flood protection system 1 is preferably automatically, i.e. the monitoring system 4 comprises a feedback mechanism that automatically will adjust the pumping action and accordingly the liquid flow, if one or more liquid level indicators 5 measures a liquid level which is different from the predetermined set value(s).

Thus the monitoring system 4 is arranged for ensuring that only the liquid flow to certain coupling units 3 of the flood protection system 1 needs to be adjusted in dependence of data from the liquid level indicator(s) 5, i.e. only the liquid flow to the flexible tubes 2 which is adjacent/nearby to the coupling unit 3 in which a liquid level indicator measures a liquid level that different from the set value, needs to be adjusted.

In a similar manner the control unit 7 can be arranged for communicating with one or more remote liquid level indicator 12 located in the water 10 which is threatening to creating the flooding. Said external liquid level indicators 12 will detect changes in the height of the water 10 e.g. during storms, whereby the monitoring system 4 can activate the pumping system 8, preferably automatically using a feedback mechanism. Thereby the flexible tubes 2 are filled with water and the flood protection system 1 according to the invention can be raised before the flooding occurs.

In the embodiment shown in FIGS. 1 and 2, each coupling unit 3 is arranged for introducing liquid into the adjacent flexible tubes 2, however since the coupling units 3 are also arranged for establishing a liquid flow communication between the interconnected flexible tubes 2, liquid can in an alternative embodiment be introduced into the flexible tubes 2 at a single central origin.

In the embodiment shown the rigid coupling units 3 comprises a first and second coupling section 13, 14 arranged side-by-side. the first coupling section is arranged for interconnecting two flexible tubes 2*a* of the first set 2*a* of flexible tubes, end-to-end, and the second coupling section 14 is arranged for interconnecting two flexible tubes 2*b* of the second set 2*b* of flexible tubes. In this way two individual flood protecting systems consisting of two separate sets of flexible tubes 2*a*, 2*b* are provided using a single coupling unit 3. This will not only provide a broader system having the advantage that it is capable of withstanding a higher pressure from the body of liquid outside the flood protection system, but also that if a puncture or tear is detected in one set of flexible tubes, e.g. the first set of tubes 2*a*, the second set of flexible tube 2*b*, will function as a second line of defense, ensuring that an effective flood protection system is maintained.

As is evident from FIGS. 1 and 2 the placement of the liquid level indicator 5 and the inlet tube 11 are reversed stepwise along the flood protection system, i.e. in one coupling unit 3*a* the liquid level indicator 5 is placed in the second coupling section 14, and the second tube 11 (for adding water to the flexible tubes) is placed in the first coupling section 13, and in the next coupling unit 3*b* along the flood protection system 1, the arrangement is reversed, such that the liquid level indicator 5 is placed in the first coupling section 13, and the second tube 11 is connected to the second coupling section 14, and so forth. In this way it is ensured that the liquid level indicators 5 are not directly affected by the liquid flows steaming from the inlet tubes 11 into the flexible tubes 2, but that the liquid level can still be measured at relative points in each set 2*a*, 2*b* of flexible tubes 2, in the flood protection system 1.

This arrangements will not only ensure that the flood protection system 1 can be filled with liquid very quickly, but also that only the liquid flow to certain sections of the flood protection system needs to be adjusted in dependence of data from the liquid level indicator(s) 5, i.e. only the water flow to the flexible tubes 2 which is adjacent/nearby to the coupling unit 3 in which a liquid level indicator measures a liquid level that different from the set value, needs to be adjusted.

In the embodiment shown each coupling section 13, 14 of coupling units 3 comprises a coupling tube 15, 16 having a cross-section that substantially corresponds to the cross-section of the flexible tubes 2, and a reinforcement part 17 surrounding said tubes 15, 16. Said reinforcement part 17 both serves for connecting the pumping system 8 to said coupling unit 3 and for providing a base 18 which provide additional support when the coupling unit is placed on the areas 19 which are to be protected by e.g. flooding.

In the present embodiment the coupling unit 3 has two coupling sections 13,14, one for each set of flexible tubes 2*a*,2*b*; but it could equally well could comprise a single coupling section providing a single set of flexible tubes. Alternatively, the coupling unit can comprise three coupling sections, e.g. arranged in a triangle, or side-by-side, or alternatively four, five or an even higher number of coupling sections if this is considered relevant depending, among others, on the intended use and area which are to be protected. In fact, the rigid coupling unit 3 can have any design and dimension, as long as said unit 3 are capable of connecting at least two flexible tubes 2, and as long as said coupling unit 3 has a rigidity which is not affected by the liquid level in the flood protection system and the forces acting upon the coupling units and the flexible tubes during use.

The flood protection system 1 according to the invention has the advantage that it will be possible to monitor and control the complete system, even when a large number of coupling units 2, are spaced apart e.g. 50 m, 100 m or even longer, by flexible tubes 2, thereby protecting a long coastline. Each liquid level indicator 5 is arranged for sending data relating to the liquid level in a specific coupling unit, and if said liquid level is different from a predetermined set value, an operator can via the monitoring system 4 determine which coupling unit 3 sends the signal. If said monitoring system further obtain information relating to the corresponding coupling units position in the flood protection system, it will be very simple for the operator to accurately locate the specific coupling unit even in extreme weather conditions.

If said liquid level indicator 5 signals that the water level is to low in the respective coupling unit 3, this could indicate that one of the tubes connected to said coupling unit has been damaged, e.g. due to a puncture or tear. In case of damage to only a single tube, the amount of water in the damage tube can initially be regulated, simply by adjusting the flow/amount of water added either to the total system or to a coupling unit 3 at or near the coupling unit 3 comprising the liquid level indicator 5 that had detected the difference in liquid level between. Said flow of liquid is preferably adjusted automatically using a feedback mechanism communicating with the pumping system 8 alone, and/or the monitoring system 4. The damaged tube(s) can then be replaced or reinforced in situ later when this is considered appropriate, e.g. when the weather clears up or the weather conditions are less hazardous.

However, extensive damage to the flood protection system 1 can cause major leakage, which cannot be corrected by continuously adding liquid to the flood protection system, as this will require that the damaged sections and/or tubes is repaired instantly. In such situations the monitoring system used in the present invention, ensures that the problem, e.g. a leak/tear is located quickly, since the operator will not have to visually inspect a large area in order to find the error, but can specifically target the exact location based on the information obtained via the monitoring system, and correct the failure, e.g. by repairing the damaged section by applying an outer membrane/patch to said section, deploy a second line of defense or evacuate.

Using the flood protection system 1 according to the invention may significantly improve the effectiveness of the work of the rescue units and thus minimize casualties as well as damage to properties.

A person skilled in the art will understand that the system 1 according to the invention, are simple to use, and that the system can not only be used for forming a flood barrier but also for other purposes such as protecting a limited area from hazardous spillage, and/or for storing liquids, without departing from the scope of this invention.

Modifications and combinations of the above principles and designs are foreseen within the scope of the present invention.

The invention claimed is:

1. A flood protection system (1) comprising at least one elongated flexible tube (2) arranged for being filled with a liquid and containing said liquid, at least one rigid coupling unit (3) arranged for interconnecting the at least one elongated flexible tube (2), and a monitoring system (4) comprising at least one liquid level indicator (5) arranged for measuring the liquid level inside the at least one coupling unit (3).

2. A flood protection system (1) according to claim 1, wherein the flood protection system (1) comprises a number of rigid coupling units (3), and wherein the monitoring system (4) is arranged for individually measuring the liquid level inside a number of coupling units (3).

3. A flood protection system according to claim 2, wherein the monitoring system (4) is arranged for individually measuring the liquid level inside each coupling unit (3) of the flood protection system (1).

4. A flood protection system (1) according to claim 1, wherein each coupling unit (3) comprises an individual liquid level indicator (5).

5. A flood protection system (1) according to claim 1, wherein the monitoring system (4) is arranged for transmitting an alert if the liquid level in at least one first coupling unit (3) is different from a predetermined set value of said first coupling unit (3).

6. A flood protection system (1) according to claim 5, wherein the predetermined set value is indicating that about 95% to 98% of the flexible tubes inner volume is filled with liquid.

7. A flood protection system (1) according to claim 1, wherein the monitoring system comprises one or more operating units (7) arranged for receiving and processing data relating to the liquid level measured by the at least one liquid level indicator (5).

8. A flood protection system (1) according to claim 1, wherein the monitoring system (4) is arranged for linking data relating to the liquid level measured by one of the at least one liquid level indicator (5) with information relating to said indicators (5) position.

9. A flood protection system (1) according to claim 1, wherein the at least one coupling unit (3) is arranged for introducing and removing liquid into the flood protection system (1) by a pumping system (8), and wherein the monitoring system comprises a mechanism arranged for adjusting the flow of liquid to and from the flood protection system in dependence of the data from the liquid level indicator (5) relating to the liquid level in said coupling unit (3).

10. A method for monitoring a condition of a flood protection system (1), wherein said method comprises;

providing a flood protection system (1) according claim 1, measuring the liquid level inside at least one coupling unit (3), establishing if said liquid level differs from a predetermined set value for said coupling unit (3), and adjusting the flow of liquid to and from the flood protection system (1) if said liquid level differs from the predetermined set value for said coupling unit.

11. A method according to claim 10, wherein the liquid level is measured inside each coupling unit (3) of the flood protection system (1), and it is established if said measured liquid level differs from a predetermined set value for each respective coupling unit (3).

12. A method according to claim 10, wherein data relating to a liquid level measured by one of the at least one liquid level indicator (5) is linked to information relating to said indicators (5) position in the flood protection system (1).

* * * * *